US006021892A

United States Patent [19]

Baudin

[11] Patent Number: 6,021,892

[45] Date of Patent: Feb. 8, 2000

[54] DEVICE FOR PACKAGING A PRODUCT COMPRISING CONSTITUENTS WHICH MUST BE STORED SEPARATELY AND MIXED JUST BEFORE USE OF THE PRODUCT

[75] Inventor: Gilles Baudin, Domont, France

[73] Assignee: L'Oreal, Paris, France

[21] Appl. No.: 09/093,342

[22] Filed: Jun. 9, 1998

[30] Foreign Application Priority Data

Jun. 20, 1997 [FR] France ..... 97 07718

[51] Int. Cl.[7] ..... B65D 25/08

[52] U.S. Cl. ..... 206/221; 206/568; 215/DIG. 8; 222/129

[58] Field of Search ..... 206/219, 220, 206/221, 222, 568; 215/6, 10, DIG. 8; 222/129, 145.5, 145.6

[56] References Cited

U.S. PATENT DOCUMENTS

| | | | |
|---|---|---|---|
| 4,693,366 | 9/1987 | Goncalves | 206/222 |
| 4,757,916 | 7/1988 | Goncalves | 215/DIG. 8 |
| 5,170,888 | 12/1992 | Goncalves | 206/222 |
| 5,447,226 | 9/1995 | Laine | 215/DIG. 8 |
| 5,647,481 | 7/1997 | Hundertmark et al. | 206/219 |
| 5,875,888 | 3/1999 | Albisetti | 206/221 |
| 5,875,889 | 3/1999 | Albisetti | 206/221 |

FOREIGN PATENT DOCUMENTS

| | | |
|---|---|---|
| 243730 | 11/1987 | European Pat. Off. . |
| 0 528 707 | 2/1993 | European Pat. Off. . |
| 1 022 625 | 3/1953 | France . |
| 2 663 304 | 12/1991 | France . |
| WO 93/25454 | 12/1993 | WIPO . |

*Primary Examiner*—Paul T. Sewell
*Assistant Examiner*—Luan K. Bui
*Attorney, Agent, or Firm*—Oblon, Spivak, McClelland, Maier & Neustadt, P.C.

[57] ABSTRACT

A device (1) for the extemporaneous mixing of N constituents (A, B) has N compartments (2*a*, 2*b*), each having a first end (22*a*, 22*b*) and a second end (24*a*, 24*b*) on the opposite side to the first, each of the first and second ends being surmounted by a neck (22*a*, 24*a*; 22*b*, 24*b*) delimiting an opening (12). (N−1) intermediate obturators (14) separate each compartment in a detachable manner from the compartment or compartments which are adjacent thereto when the N compartments are placed on one another. An actuator (18) is provided for ejecting the (N−1) intermediate obturators (14) for effecting the mixing of N constituents, and first end obturators (8) and second end obturators (9) are provided for obturating the end openings of the first compartment (22*a*) and of the $N^{th}$ compartment (24*b*). One of the first or second end obturators has an opening (26) for the dispensing of the mixture. The first and second ends of any of the N compartments can receive any of the said obturators.

14 Claims, 3 Drawing Sheets

DEVICE FOR PACKAGING A PRODUCT COMPRISING CONSTITUENTS WHICH MUST BE STORED SEPARATELY AND MIXED JUST BEFORE USE OF THE PRODUCT

BACKGROUND OF THE INVENTION

1. Field of the Invention

The present invention relates to a device for packaging and dispensing a product comprising several constituents which must be stored separately and mixed just before the product is used, with a view to its application to a suitable base. The invention relates more particularly for the storing, mixing and dispensing of a cosmetic or dermatological product obtained by mixing two, three, four or more constituents. Such a product is, for example, a hair dye, or a hair perm composition which usually takes the form of at least two constituents of which one contains, for example, oxidizing or reducing agents which must only come into contact with active agents (or colorants) of the other constituent of the product at the time of application, since in the medium term one of these constituents causes the other to be rendered inactive. A third or even a fourth constituent may contain respectively a perfume or a hair conditioning agent, a sun-protection agent, or a surfactant.

2. Description of the Related Art

From FR-A-1 542 467 there is known a packaging unit for a two constituent product, comprising first and second compartments for the two constituents, these compartments being placed on one another and assembled by means of an intermediate connecting element slidably mounted relative to each compartment and having an outlet duct. Opposite each end of the intermediate connecting element, a stopper obturates the outlet of each compartment. When it is intended to mix together the constituents contained in each compartment for applying the mixture obtained, the two compartments are brought together to eject the stoppers so as to open the outlet of the intermediate element and allow the two constituents to be mixed.

This packaging unit has two main drawbacks. On the one hand, it is difficult to ensure an adequate seal between the intermediate elements and each compartment, respectively, in that when this seal has not been ensured leaks of one or the other constituent towards the outside may occur. On the other hand, during the ejection of the stoppers a reduction of the total volume of the packaging unit is produced, which results in an increase in the internal pressure. It is therefore necessary to ensure a perfect seal between the sliding parts, which in practice is difficult to obtain on an industrial scale. Moreover, when the packaging unit of the prior art is opened after mixing, there is the risk that the excess pressure obtaining inside will produce splashes, which is very detrimental because corrosive constituents may be used in the intended fields of application.

SUMMARY OF THE INVENTION

It is an object of the present invention to remedy the above mentioned drawbacks by providing an improved device for packaging and applying a product with several constituents that is simple and economic to make, and having a reliable and durable seal, particularly in the presence of corrosive constituents.

It is a further object of the present invention to provide a unit which does not produce a reduction in volume during the mixing of the constituents, thus avoiding any internal excess pressure and the undesirable effects produced by excess pressure.

It is a further object of the present invention to reduce the number of constituent parts of the packaging, and to facilitate their assembly so as to substantially reduce manufacturing costs.

It is a further object of the present invention to permit the use of identical compartments for the various constituents, which is advantageous from an economic point of view, more particularly compartments having two identical necks, which provides wide scope from an industrial point of view during filling and assembly.

It is a further object of the present invention to provide for the packaging and application of a hair dye.

According to the invention, a device for the extemporaneous mixing of N constituents has N compartments, each having a first end and a second end remote from the first, each of the first and second ends being surmounted by a neck delimiting an opening. (N−1) intermediate obturators are carried by (N−1) connecting elements so as to separate each compartment in a detachable manner from the compartment or compartments which are adjacent thereto when the N compartments are placed on one another. An actuator is provided for ejecting the (N−1) intermediate obturators with a view to effecting the mixing of N constituents. First and second end obturators obturate end openings of the first and $N^{th}$ compartments. One of the first or second end obturators has an opening for dispensing the mixture. According to the invention, the first and second ends of any of the N compartments are adapted to receive any of the end obturators or the (N−1) connecting elements.

Advantageously, the various components of this unit are aligned along a common longitudinal axis of symmetry.

According to an advantageous characteristic of the invention, each of the (N−1) intermediate obturators comprises a stopper, each stopper being in contact with a first end of an actuating stem, the second end of the actuating stem being in the vicinity of either another intermediate obturator, or of one of the said first or second end obturators, the actuator being capable of producing an axial displacement of the actuating stems, and the ejection of each of the (N−1) intermediate obturators.

In the device in accordance with the invention, the actuator is mounted to an axially deformable zone which may be present either in the first or the second end obturator. This deformable zone may take the form of a flexible dome or a deformable bellows.

Advantageously, each stopper is joined to the first end of the actuating stem which is associated therewith. Thus the device in accordance with the invention generally comprises (N−1) connecting elements for supporting each one of the (N−1) stoppers, each one of the connecting elements connecting two adjacent compartments and comprising a first skirt and a second skirt with a larger internal diameter than the external diameter of the first, so as to define on either side of a transverse partition two annular zones orientated in opposition to one another, one receiving a neck of a first compartment and the other receiving a neck of a second compartment adjacent to the first.

Advantageously, each connecting element comprises a third skirt for mounting the corresponding stopper, this third skirt being coaxial with the first and second skirts and having a diameter smaller than the diameter of the first skirt. In this case, the stopper is force fitted in the third skirt.

The first and second necks of each compartment are identical. Thus in practice, each compartment may be symmetrical along a median plane perpendicular to the longitudinal axis of the unit. This allows wide scope for combinations as regards the assembly of the compartments on the connecting element or elements and on the first and second end obturators respectively. It is advantageous, in particular from an industrial point of view, to be able, for example, to invert a first and a second compartment. Because of their geometrical identity, a single industrial tool is capable of manipulating independently any of the compartments and/or connecting elements.

In practice it is advantageous from an industrial point of view to use N compartments of an identical shape for packaging a product of N constituents. The fact that N compartments are available with identical necks makes it possible to set up a modular multi-compartment device by using components of the same type as those used for a device with two compartments. Thus it is possible to make units with three compartments or even four or five compartments, etc., such units being intended for the storage and packaging of as many constituents as there are compartments. Most frequently, a device is used with 2, 3 or 4 compartments. Thus it is possible to package in a single device, for example, a hair dye comprising hair colorants, oxidizing agents, perfumes, hair conditioning agents, etc.

In accordance with a preferred embodiment, each of the compartments comprises a body connecting the first end to the second end, each of these connecting elements comprising an external cover skirt with an external diameter substantially the same as the external diameter of the body of the compartments connected thereby. This cover skirt gives the device a uniform external contour. Thus the connecting element may comprise a cover skirt with an external diameter substantially identical with the external diameter of the first and second bodies, which allows these bodies to be aligned along a cylindrical contour. In this case, the cross-section of the unit may be circular or oval.

According to another advantageous characteristic of the invention, the axially deformable zone is annular. In this case, the axially deformable zone may be carried by the end obturator carrying the opening for dispensing the mixture, this dispensing opening being situated at the top of a dispensing nozzle intended for the dispensing and application of the mixture of the constituents. To ensure the closure of the device during transit and storage, the dispensing opening is obturated, for example by a cap, that can be cut off by the user before use. It may be understood that any other closing system generally used for this kind of device may be used.

Advantageously, the end obturator which does not have the dispensing opening is intended to form the base of the unit, and has a bottom allowing the device to be placed in a stable manner on a working surface.

BRIEF DESCRIPTION OF THE DRAWINGS

To render the present invention more readily understood, embodiments of devices in accordance with the invention will be described below by way of purely illustrative and in no way restrictive examples, represented in the attached drawings, in which.

DETAILED DESCRIPTION OF THE PREFERRED EMBODIMENTS

Figure 1:
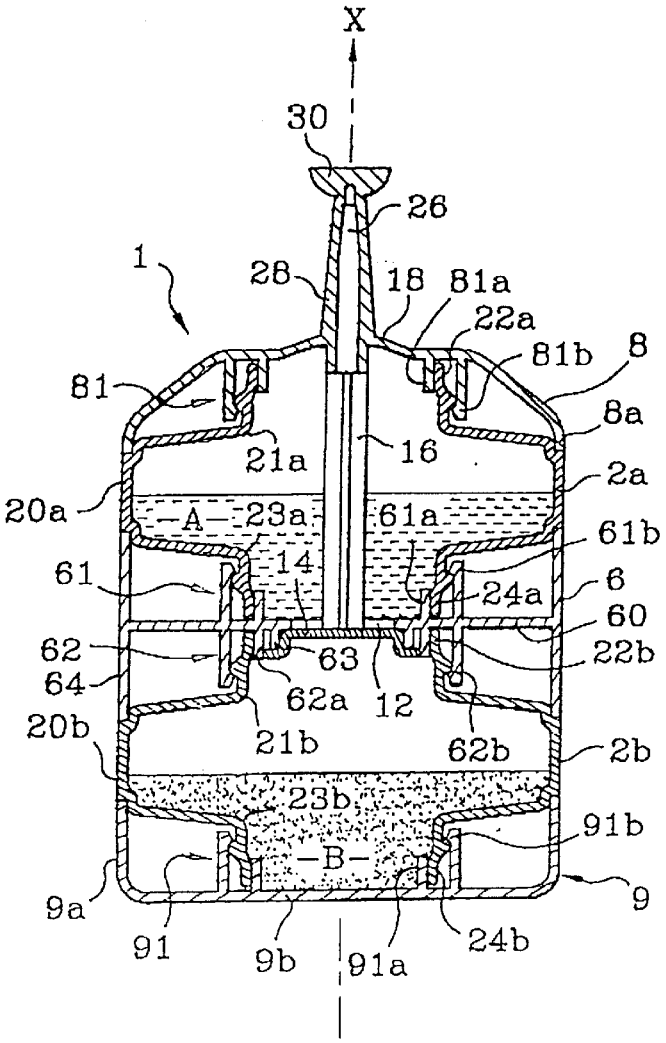
FIG. 1 shows a device in an axial section according to a first embodiment of the invention, in its storage position.
Figure 2:
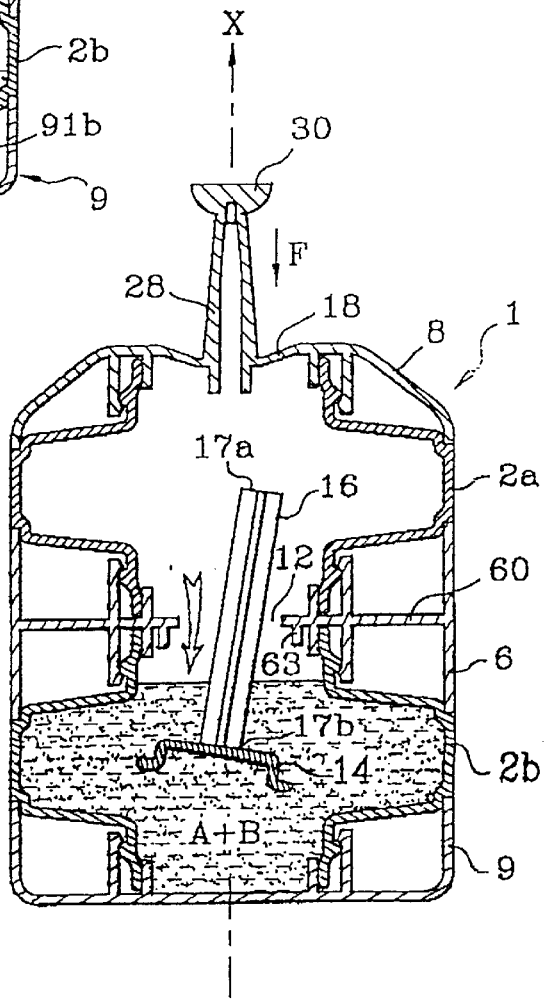
FIG. 2 shows an axial section of the device of FIG. 1 in its position of use.

Referring to FIGS. 1 and 2, a packaging device 1 for the extemporaneous mixing of two constituents A and B stored separately in an upper first compartment 2*a* and a lower second compartment 2*b* respectively, has an axis X. The constituents A and B may be, for example, an oxidizing constituent and a coloring constituent, whose mixture is intended for dyeing the hair. The first compartment is formed by a first body 20*a* and the second compartment is constituted by a second body 20*b*, the two bodies being joined by a connecting element 6. This connecting element 6 has a circular central opening 12 permitting the first compartment 2*a* to communicate with the second 2*b*. In the storage position shown in FIG. 1, the opening 12 is obturated by an obturating element 14 such as a detachable stopper of a circular shape complementary to the shape of the opening 12.

For assembly of the bodies 20*a* and 20*b* respectively, each body has at a first end 21 a or 21*b*, a first open neck 22*a* or 22*b*, and at a second end 23*a* or 23*b* opposite to the first, a second open neck 24*a* and 24*b*. As shown in the drawings, all the necks 22*a*, 22*b*, 24*a* and 24*b* have the same geometry and dimensions.

The second neck 24*b* of the lower compartment 2*b* is obturated by a second obturating element 9, here in the form of a base. The obturating element 9 has a side wall 9*a* allowing it to be aligned with the external contour of the body 20*b* of the second compartment 2*b*. The base 9 has a flat bottom 9*b* to ensure the stability of the unit 1 when it is placed onto a working surface.

A third obturating element 8 is provided to obturate the first neck 22*a* of the upper compartment 2*a* and to permit dispensing of the mixture of the constituents A and B. For this purpose, it is provided with a dispensing opening 26 through which the dispensing of the mixture can be effected. The dispensing opening is here situated at the end of a hollow dispensing nozzle 28 that is closed by a closing cap 30 which the user removes, for example by twisting, before the mixture A+B is dispensed. The obturating element 8 has a side wall allowing it to be aligned with the external contour of the body 20*a* of the upper compartment 2*a*.

The connecting element 6 has a partition 60 orientated perpendicularly to the axis X. The opening 12 is cut at the center of this partition 60. A double cylindrical skirt 61, 62 is concentrically disposed relative to the opening 12 on each side of the partition 60, which skirt constitutes the connector and whose function will be described below in greater detail. At its circumference, the partition 60 has an external skirt 64 with an external diameter substantially equal to the external diameter of an external contour of the compartments 2*a* and 2*b*, this external skirt forming a cover skirt.

Thus, four identical connecting elements 61, 62, 81, 91 are provided to cooperate each with the identical necks 22*a*, 24*a*, 22*b*, 24*b* of the compartments 2*a* and 2*b*. These connecting elements comprise a double cylindrical skirt, whereof a first 61 a, 62*a*, 81 a, 91 a is adapted to be inserted with a force fit inside each neck 22*a*, 24*a*, 22*b*, 24*b*. A second skirt 61*b*, 62*b*, 81*b*, 91*b* concentric with the first, is provided to be fitted with a tight fit on the outer side of each neck. If necessary, this second skirt 61*b*, 62*b*, 81*b*, 91*b* takes a discontinuous form. Thus a first double skirt 81 is situated on the internal side of the obturating element 8; a second double skirt 61 and third double skirt 62 are symmetrically situated on either side of the partition 60 of the connecting element 6.

A fourth annular skirt 63 with a smaller diameter than that of the cylindrical double skirt surrounds the opening 12 and serves as a seat for fixing the stopper 14.

The skirts 61, 62, 81, 91 for coupling the connecting element 6 on the compartments may also have a thread system. In this case the second skirts 61*b*, 62*b*, 81*b*, 91*b* have an internal thread and are screwed onto the necks 22*a*, 24*a*, 22*b*, 24*b* of the compartments 2*a* and 2*b*, these necks being provided with an appropriate complementary thread.

In accordance with this embodiment, the obturating element 8 further comprises actuator for causing the stopper 14 to be ejected. The actuator is formed by an annular zone 18 surrounding the base of the dispensing nozzle 28, in the shape of a flattened cone frustum emerging towards the outside. The annular zone 18 is formed by a wall of a sufficiently small thickness to be deformable by axial depression, as shown in FIG. 2. The annular zone has an internal tube forming an extension of the nozzle 28, intended to come into contact with a first end 17*a* of an axially extending stem 16 whose second end 17*b* is in contact with the stopper 14. To position the stem 16 accurately between the annular zone and the stopper, its second end 17*b* is joined to the stopper 14. Advantageously, the stem 16 and the stopper are made of a single piece.

According to another possibility (not shown), the actuator having a deformable zone may be situated at the bottom of the device. In this case, the deformable zone is located at the center of the bottom of the element 9 and takes the form of a bellows, for example. It is, of course, understood that the stopper and its stem are here disposed inversely to the arrangement shown in FIG. 1, relative to the opening 12. In other words, in this configuration, the stem passes through the lower compartment 2*b*; its ends are in contact with the deformable zone of the bottom and the stopper 14 respectively. During the ejection of the stopper, the latter is accommodated in the first compartment 2*a*.

Generally the parts forming the device of the invention are made of a thermoplastic material compatible with the product, for example of polypropylene. The connecting element 6 and the obturating elements 8, 9 and 14 are advantageously obtained by injection molding. As for the bodies 20*a* and 20*b* of the compartments 2*a* and 2*b*, they may be made of PVC (polyvinyl chloride). These bodies are advantageously made by blow molding.

The functioning of the device which has been described is illustrated in FIG. 2: to cause the first constituent A to be transferred into the second compartment 2*b* for mixing the two constituents A and B, the user depresses the deformable zone 18 by pressing thereon. The depression of this zone 18 produces an axial translation of the stem 16, which in its turn produces the detachment of the stopper 14 from its seat and the release of the first opening 12. The first constituent A flows by gravity into the second compartment 2*b* where it is mixed with the second constituent B. After shaking the unit 1, the user then removes the closing cap 30 simply by twisting it, thus releasing the dispensing opening 26. By upending the unit 1, the dispensing nozzle 28 being directed towards the bottom, the mixture of the constituents A+B can be applied to a base to be treated, for example to the hair.

Figure 3:
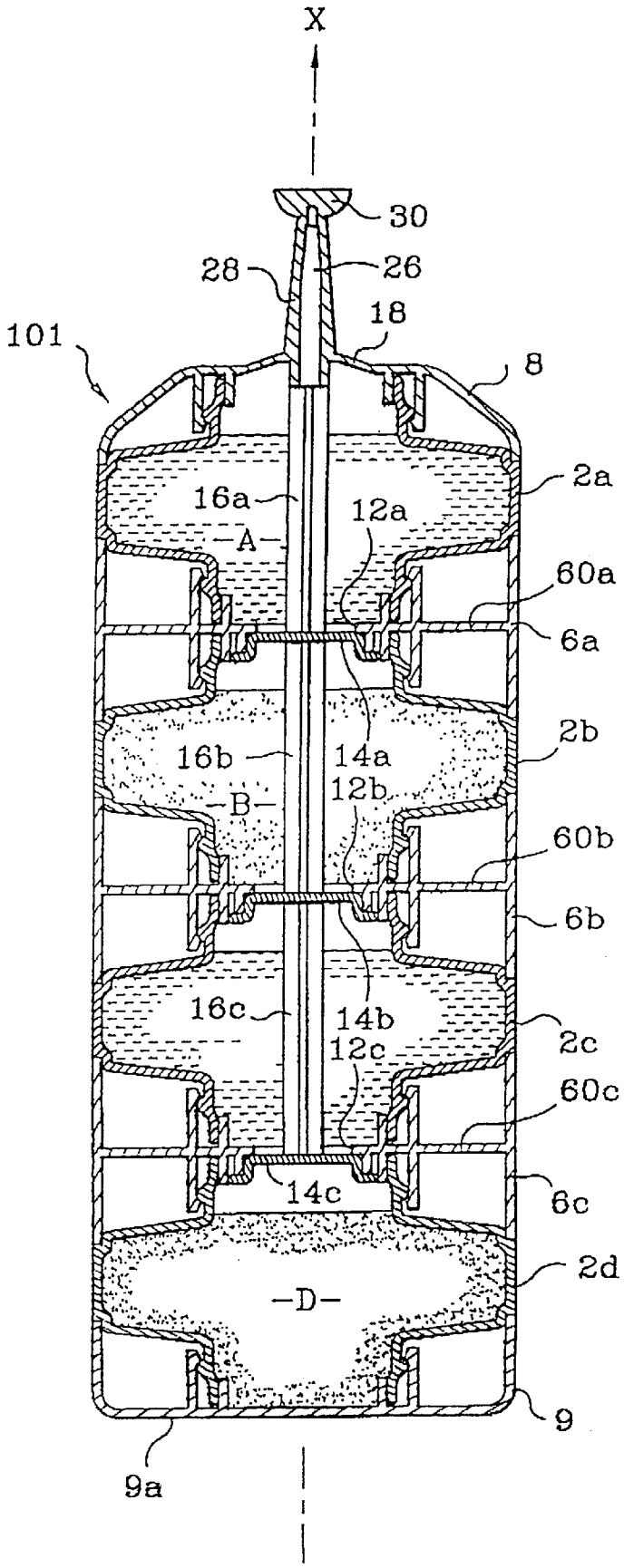
FIG. 3 shows a device in an axial section, according to a second embodiment of the invention, designed for storing four constituents, in its storage position.
Figure 4:
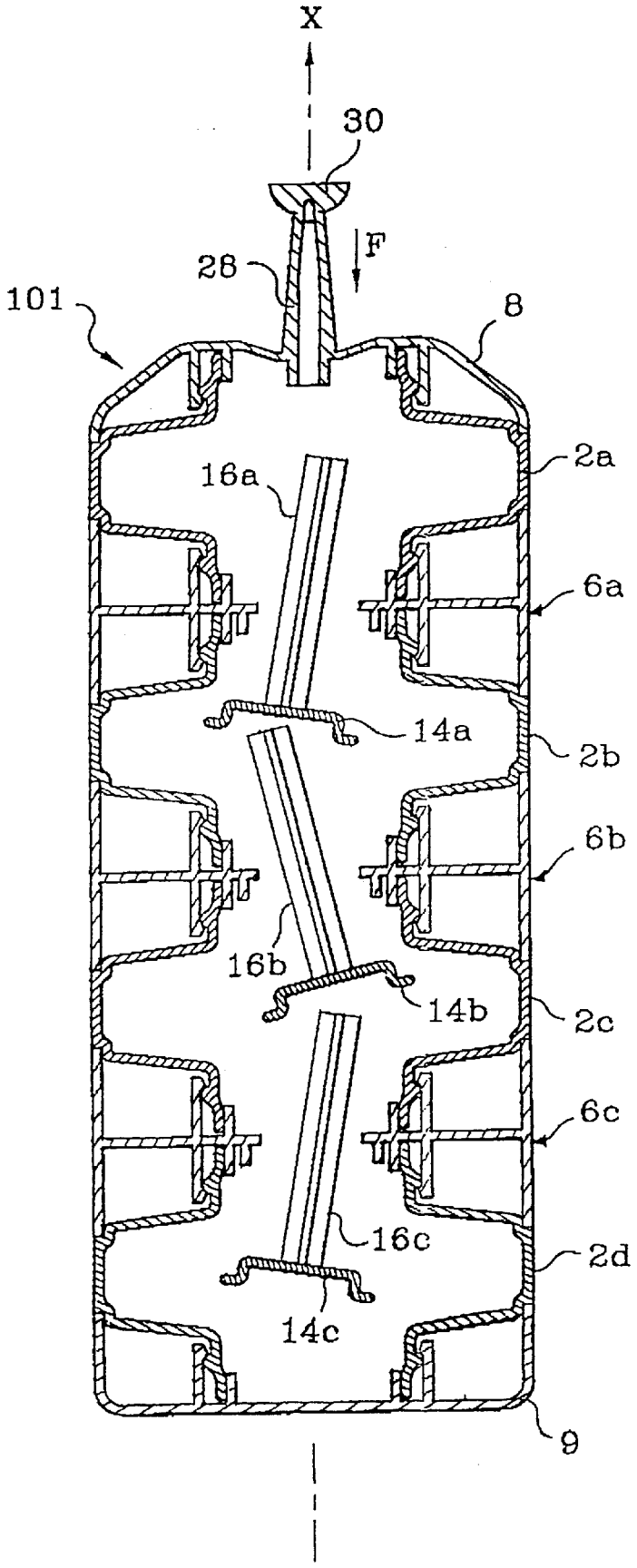
FIG. 4 shows an axial section of the device of FIG. 3 in its position of use.

As shown in FIGS. 3 and 4, a packaging device 101 intended for packaging four constituents A, B, C and D has parts identical with the parts forming the device 1. Thus the device is surmounted by an upper obturating element 8 provided with a dispensing nozzle 28, itself closed by a detachable closing cap 30. The obturating element 8 has a deformable zone 18 which may be depressed by the user in a similar way to that described with reference to the device of FIGS. 1 and 2, with a view to effecting the mixing of the constituents A to D. The base of the device 101 is formed by a lower obturating element 9 with a flat bottom 9*a*. Between the upper obturating element 8 and lower obturating element 9 are four identical axially aligned compartments 2*a*, 2*b*, 2*c* and 2*d*, each compartment being connected to an adjacent compartment by one of the identical connecting elements 6*a*, 6*b* or 6*c*. Detachable stoppers 14*a*, 14*b* and 14*c* are respectively mounted to the connecting elements 6*a*, 6*b* or 6*c*, thus ensuring the hermetic packaging of each constituent A, B, C and D. Each of the stoppers 14*a*, 14*b* and 14*c* is respectively provided with a central stem 16*a*, 16*b* and 16*c* orientated towards the dispensing nozzle 28 and ending in the vicinity of an adjoining stopper, with the exception of the stem 16*a* placed at the top, which ends in the vicinity of the deformable zone 18.

When the user wishes to apply the product, he depresses the dispensing nozzle 28 towards the bottom 9*a*. This nozzle bears against the stem 16*a* and ejects the stopper 14*a*. The stopper 14*a* then bears against the stem 16*b* of the stopper 14*b*, causing the latter to be ejected. The stopper 14*b* comes into contact with the stem 16*c* of the stopper 14*c* and causes, in its turn, the ejection of the latter. In this way, all the compartments 2*a* to 2*d* communicate with one another, so that their contents accumulate in the bottom portion of the device 101. By vigorously shaking the unit 101, a homogeneous mixture of the constituents A to D is obtained. It then suffices to remove the detachable cap 30, to direct the nozzle 28 downwards and to dispense the mixture. In this way, it is possible to make up a device with N compartments intended to contain N different constituents.

It should be noted that the devices described above have all the advantages of a modular system, making it for example possible to assemble various compartments in a variable order, or to invert the orientation of one or several compartments, which provides wide scope for mounting and filling from an industrial point of view.

I claim:

1. A device for mixing N constituents, wherein N is greater than 2, comprising:

N aligned compartments, each of the compartments having opposite first and second ends, each of the first and second ends of each said compartment being surmounted by a neck delimiting an opening, wherein adjacent ones of the compartments have facing pairs of the openings;

(N−1) removable intermediate obturators sealing the facing pairs of openings;

(N−1) connecting elements detachably connecting adjacent ones of the compartments;

an actuator mounted for ejecting said intermediate obturators from the openings for mixing of constituents in said compartments; and first and second end obturators respectively obturating opposite end openings of opposite end ones of said compartments, one of said first and second end obturators having a dispensing opening for dispensing the mixed constituents, wherein the first and second ends of any of the N compartments are configured to receive any of said end obturators and said connecting elements.

2. A device according to claim 1, wherein said actuator comprises (N−1) actuating stems, each of said actuating stems having one end in contact with one of said intermediate obturators, and another end positioned to receive and transmit an axial displacement of the actuator.

3. A device according to claim 2, wherein each of the intermediate obturators comprises a stopper.

4. A device according to claim 3, wherein each said stopper is joined to the first end of one of said the actuating stems.

5. A device according to claim 3, wherein said actuator further comprises one of said end obturators having an axially deformable zone to provide the axial displacement.

6. A device according to claim 1, wherein said connecting elements each comprises:

a transverse partition;

first skirts extending on one side of the transverse partition; and second skirts extending on an opposite side of the transverse partition, the second skirts having an internal diameter larger than an external diameter of the first skirts, so as to define two oppositely oriented annular zones on opposite sides of the transverse partition, one of the zones receiving the neck of a first compartment, the other of the zones receiving a neck of a second compartment adjacent to the first compartment.

7. A device according to claim 6, wherein each of the connecting elements further comprises a third skirt for the mounting one of the intermediate obturators, said third skirt being coaxial with the first skirt and the second skirt, and having a diameter smaller than a diameter of the first skirt.

8. A device according to claim 6, wherein each of the compartments comprises a body connecting the first end thereof to the second end thereof, each of the connecting elements comprising a cover skirt with an external diameter substantially identical with an external diameter of the body of the compartments connected thereby.

9. A device according to claim 5, wherein the axially deformable zone is an annular zone.

10. A device according to claim 9, wherein said one of said end obturators having an axially deformable zone has a dispensing nozzle including said dispensing opening.

11. A device according to claim 1, wherein said dispensing opening is obturated by a cap that can be cut off.

12. A device according to claim 1, wherein all of said compartments are identical.

13. A device according to claim 1, wherein there are up to four of said compartments.

14. A device according to claim 12, wherein the constituents are selected from the group consisting of hair dyes, oxidants, perfumes and hair conditioning agents.

* * * * *